US006508369B2

(12) United States Patent
Wang

(10) Patent No.: US 6,508,369 B2
(45) Date of Patent: Jan. 21, 2003

(54) DISPLAY STAND FOR USE WITH SPRINKLER NOZZLES

(76) Inventor: Tzu-Meng Wang, No. 91, Kwo-Tai Rd., Chu-Nan Chen, Miao-Li Hsien (TW)

( * ) Notice: Subject to any disclaimer, the term of this patent is extended or adjusted under 35 U.S.C. 154(b) by 0 days.

(21) Appl. No.: 09/837,026

(22) Filed: Apr. 18, 2001

(65) Prior Publication Data

US 2002/0153336 A1 Oct. 24, 2002

(51) Int. Cl.[7] ..... A47F 7/00
(52) U.S. Cl. ..... 211/60.1; 211/70.6; 211/65; D6/469
(58) Field of Search ..... 211/60.1, 70.6, 211/71.01, 74, 65; D6/469

(56) References Cited

U.S. PATENT DOCUMENTS 2,322,797 A * 6/1943 Fishel ..... 211/69
3,365,761 A * 1/1968 Kalvig ..... 24/257
5,957,572 A * 9/1999 Wedekind et al. ..... 362/365
6,029,829 A * 2/2000 Ovadia ..... 211/85.2
6,164,448 A * 12/2000 Schmutz et al. ..... 206/488
D454,013 S * 3/2002 Wang ..... D6/469

* cited by examiner

*Primary Examiner*—Daniel P. Stodola
*Assistant Examiner*—Khoa Tran
(74) *Attorney, Agent, or Firm*—Thorp Reed & Armstrong, LLP

(57) ABSTRACT

A display stand for use with sprinkler nozzles has a top frame and a bottom frame. The top frame has multiple retainers detachably mounted in through holes defined in the top frame, and the bottom frame has multiple blind holes adapted to accommodate handles of the sprinkler, such that the sprinklers are able to be transported and displayed easily.

5 Claims, 7 Drawing Sheets

DISPLAY STAND FOR USE WITH SPRINKLER NOZZLES

BACKGROUND OF THE INVENTION

1. Field of the Invention

The present invention relates to a display stand, and more particularly to a display stand for use with sprinkler nozzles. The display stand is able to securely clamp heads of the sprinkler nozzles by means of retainers detachably mounted on the display stand and handles of the sprinkler nozzles by blind holes defined in a bottom board of the display stand.

2. Description of Related Art

Normally, sprinkler nozzles are displayed for sale in shops in lines according to the size of the sprinkler nozzles. That is, the shop clerk must put the sprinkler nozzles on display one by one and categorize the sprinkler nozzles by size manually, which is quite a waste in time and labor.

To overcome the shortcomings, the present invention intends to provide an improved display stand for use with sprinkler nozzles to mitigate and obviate the aforementioned problems.

SUMMARY OF THE INVENTION

The primary objective of the invention is to provide a display stand for use with sprinkler nozzles. The display stand is able to clamp heads of the sprinkler nozzles of different sizes by the retainers and seat handles of the sprinkler nozzles in blind holes in a bottom board to facilitate transportation and storage of the sprinkler nozzles.

Other objects, advantages and novel features of the invention will become more apparent from the following detailed description which taken in conjunction with the accompanying drawings.

DETAILED DESCRIPTION OF PREFERRED EMBODIMENT

Figure 1:
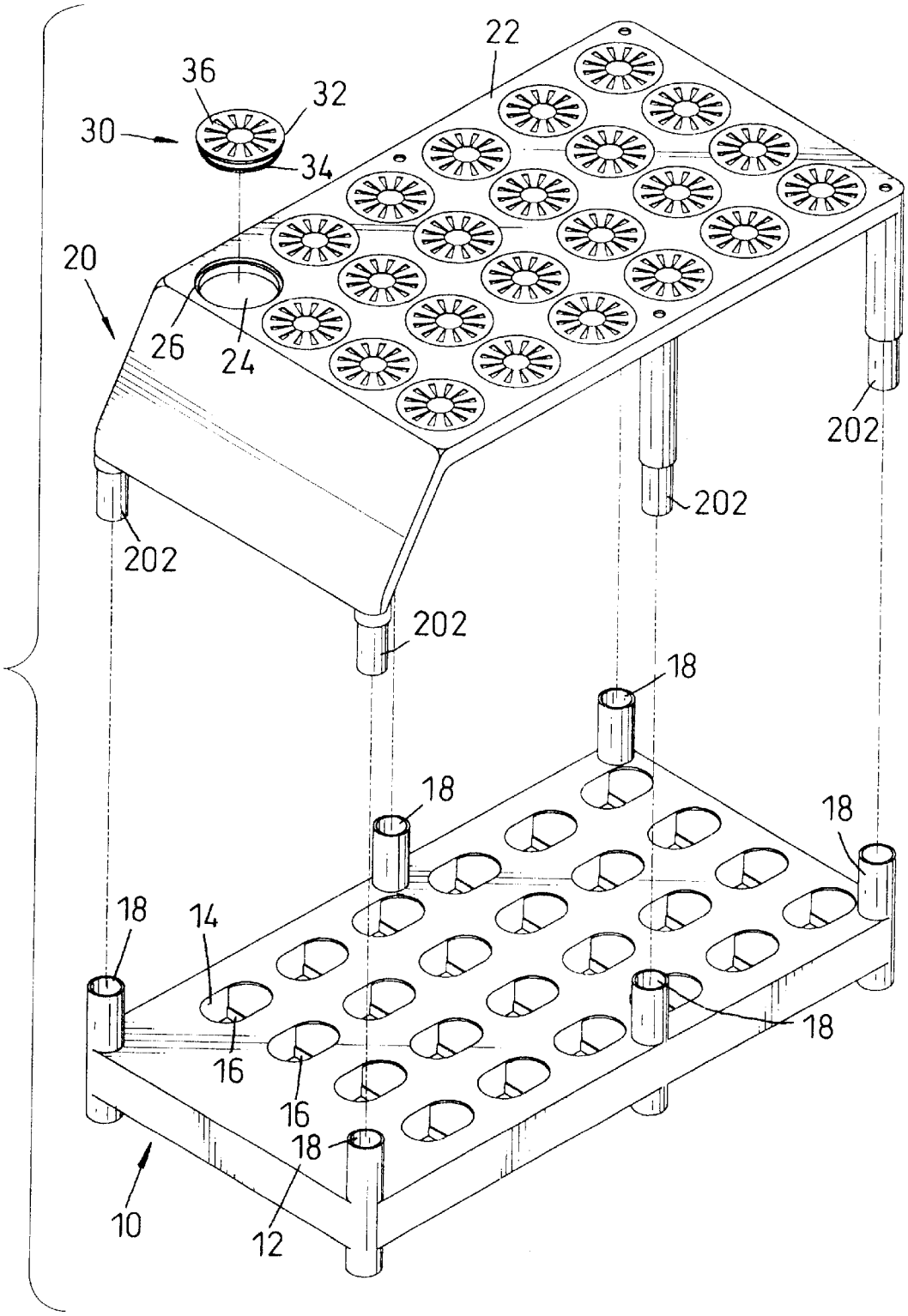
FIG. 1 is an exploded perspective view of a display stand in accordance with the present invention.
Figure 1A:
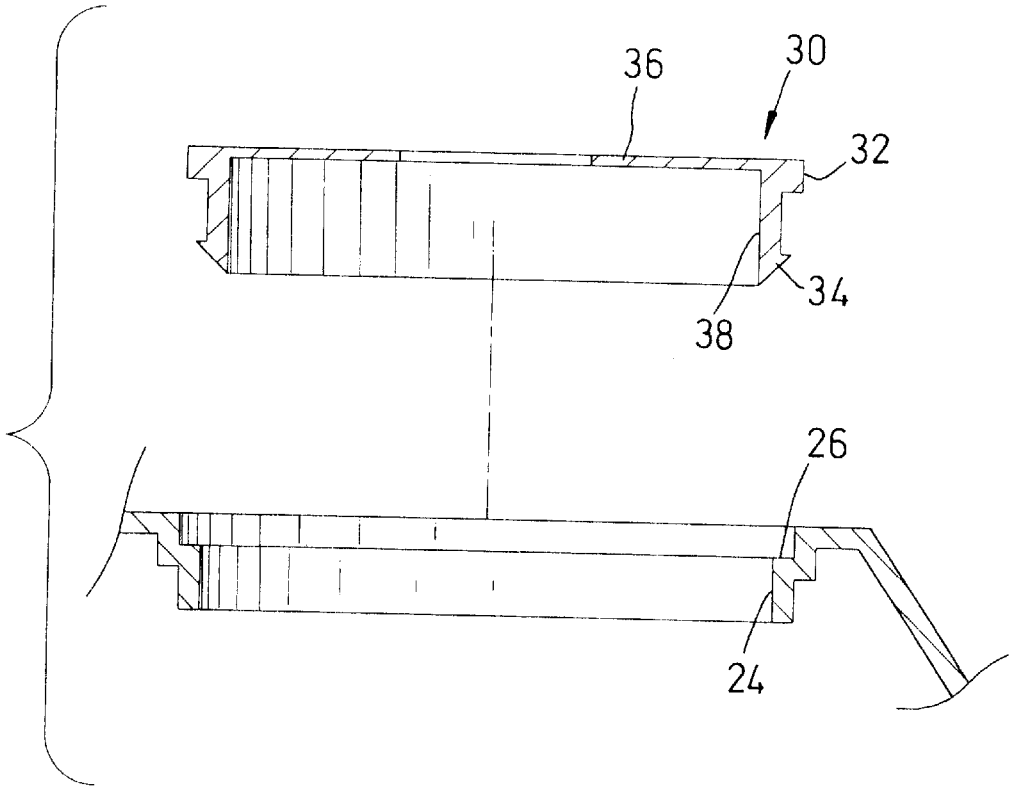
FIG. 1A is a cross sectional side plan view of the retainer and the through hole in the top board of the display stand in FIG. 1.

With reference to FIGS. 1 and 1A, the display stand in accordance with the present invention has a bottom frame (10) and a top frame (20).

The bottom frame (10) has a bottom board (12) with multiple hollow supports (18) integrally formed on edges of the bottom board (1 2) and multiple equally spaced blind holes (14) defined in the bottom board (12). Each one of the blind holes (14) has a positioning plate (16) securely formed on an inner side face defining the blind hole (14).

The top frame (20) has a top board (22) with multiple legs (202) and through holes (24). The legs (202 extend downward and correspond to the hollow supports (18) on the bottom board (12). The through holes (24) are defined in the top board (22). A resilient, nozzle retainer (30) is mounted in each through hole (24) in the top board (22). Each of the through holes (24) has a shoulder (26) formed on an inner face defining the through hole (24). Each of the retainers (30) is a disk like element and has a first flange (32), a second flange (34) separate from the first flange (32), multiple resilient retaining plates (36) and a central through hole (38).

The distance between the first flange (32) and the second flange (34) is equal to the distance from the shoulder (26) to a bottom edge of the through hole (24). When the retainer is inserted into the through hole (24), the first flange (32) is pressed flush with the top face of the top board (22). The resilient second flange (34) compresses as it is pressed through the through hole (24) and springs back to its original shape when it passes clear of the through hole (24) to securely clamp a distal edge defining the through hole (24).

Figure 2:
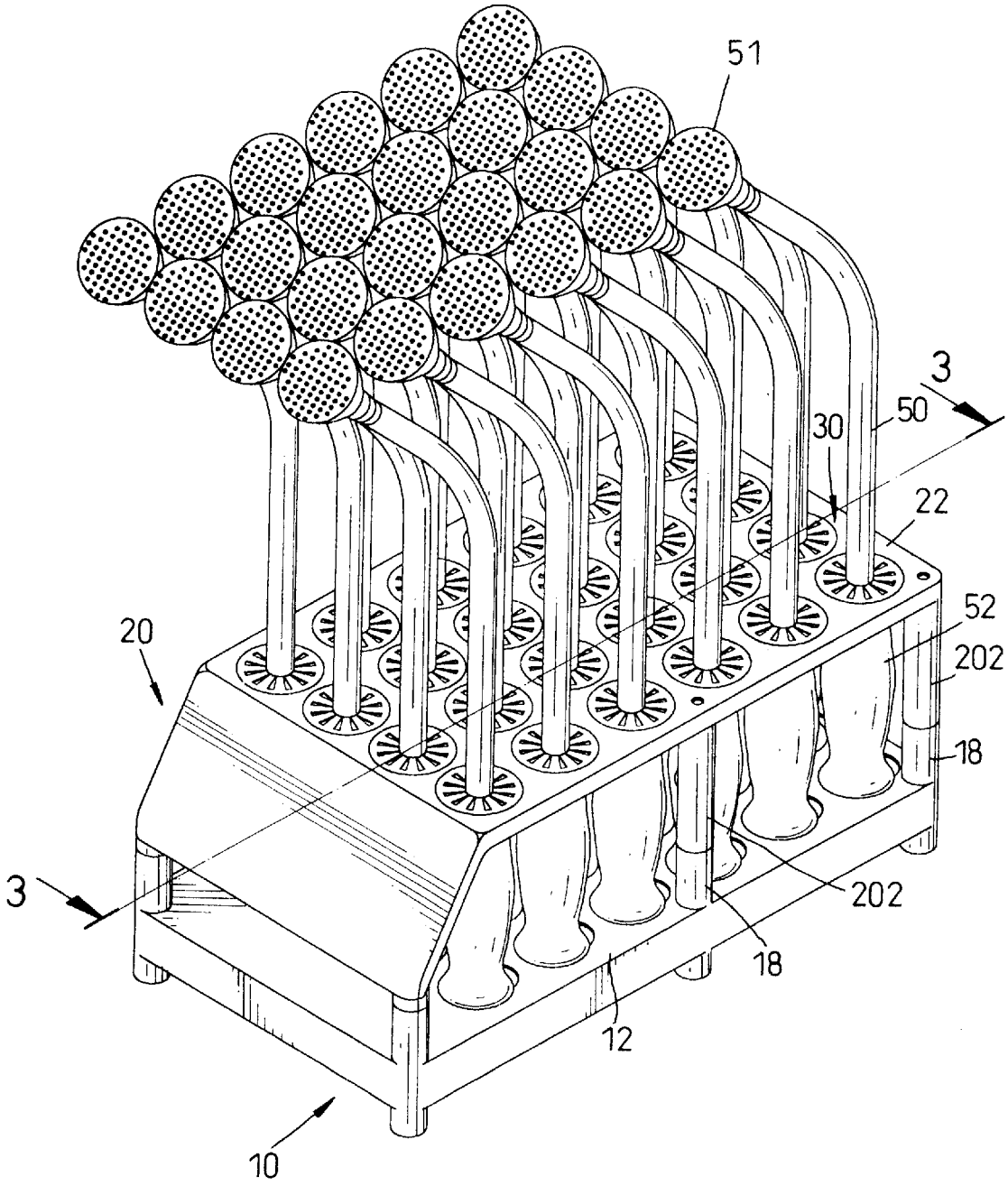
FIG. 2 is a perspective view of the display stand in FIG. 1 with sprinkler nozzles detachably mounted in the display stand.
Figure 3:
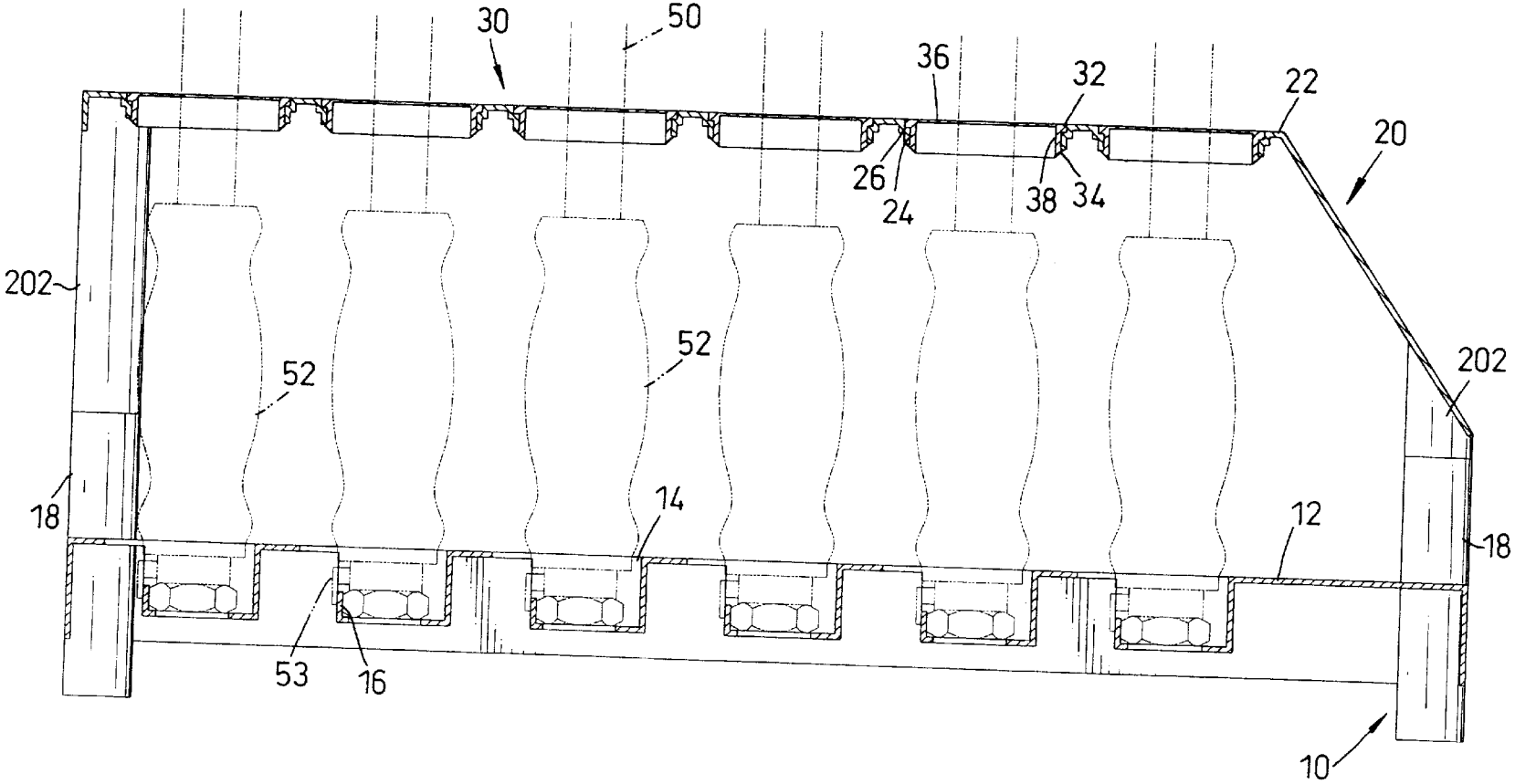
FIG. 3 is a cross sectional left side plan view of the display stand along line 3—3 in FIG. 2.

With reference to FIGS. 2 and 3, first the retainers (30) are installed in the through holes (24) and the top frame (20) is assembled with the bottom frame (10) by inserting the legs (202) into the corresponding hollow supports (18). Then a sprinkler nozzle (50) with a handle (52) can be securely seated in the display stand. Because the resilient retaining plates (36) are able to be deformed within a specific range, heads (51) of the sprinklers (50) are able to pass through the resilient retaining plates (36) and then be held by the resilient retaining plates (36). Then, the handles (52) of the sprinklers (50) are able to be seated in the blind holes (14) with the adjusting knobs (53) supported by the positioning plates (16).

Figure 4:
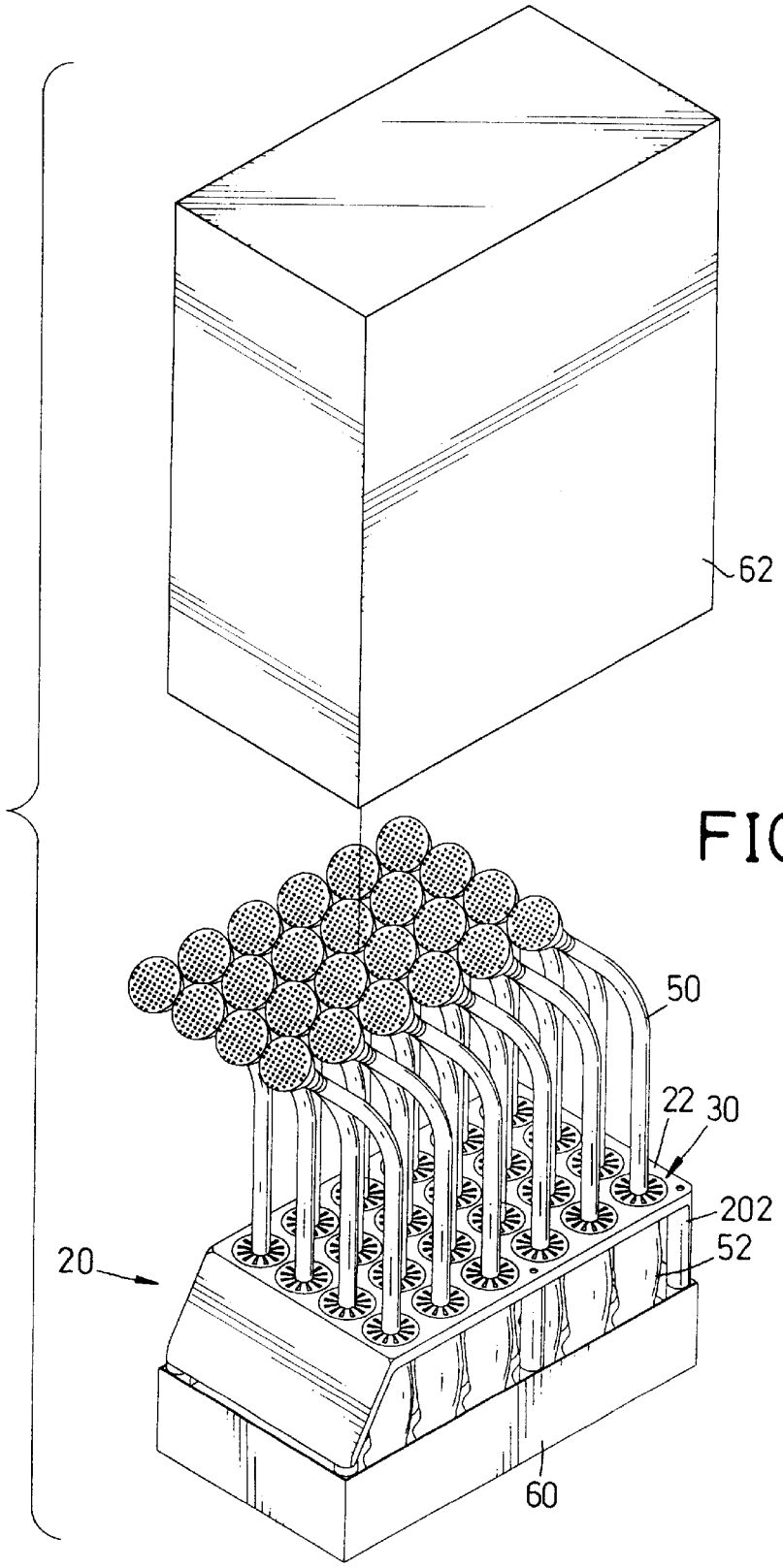
FIG. 4 is an exploded perspective view of the display stand in FIG. 1 in a cardboard box.

With reference to FIG. 4, the fully populated display stand can be packaged in a cardboard box for transportation and storage. The cardboard box includes a bottom box (60) and a top box (62). The bottom box (60) is configured to snugly hold the bottom frame (10). The top box (62) is configured to encase a display stand with sprinkler nozzles (50) and slip over the bottom box (60). When the display stand is to be transported, the user only needs to secure the top box (62) to the bottom box (60). The user is able to transport the display stand and sprinkler nozzles easily.

Figure 5:
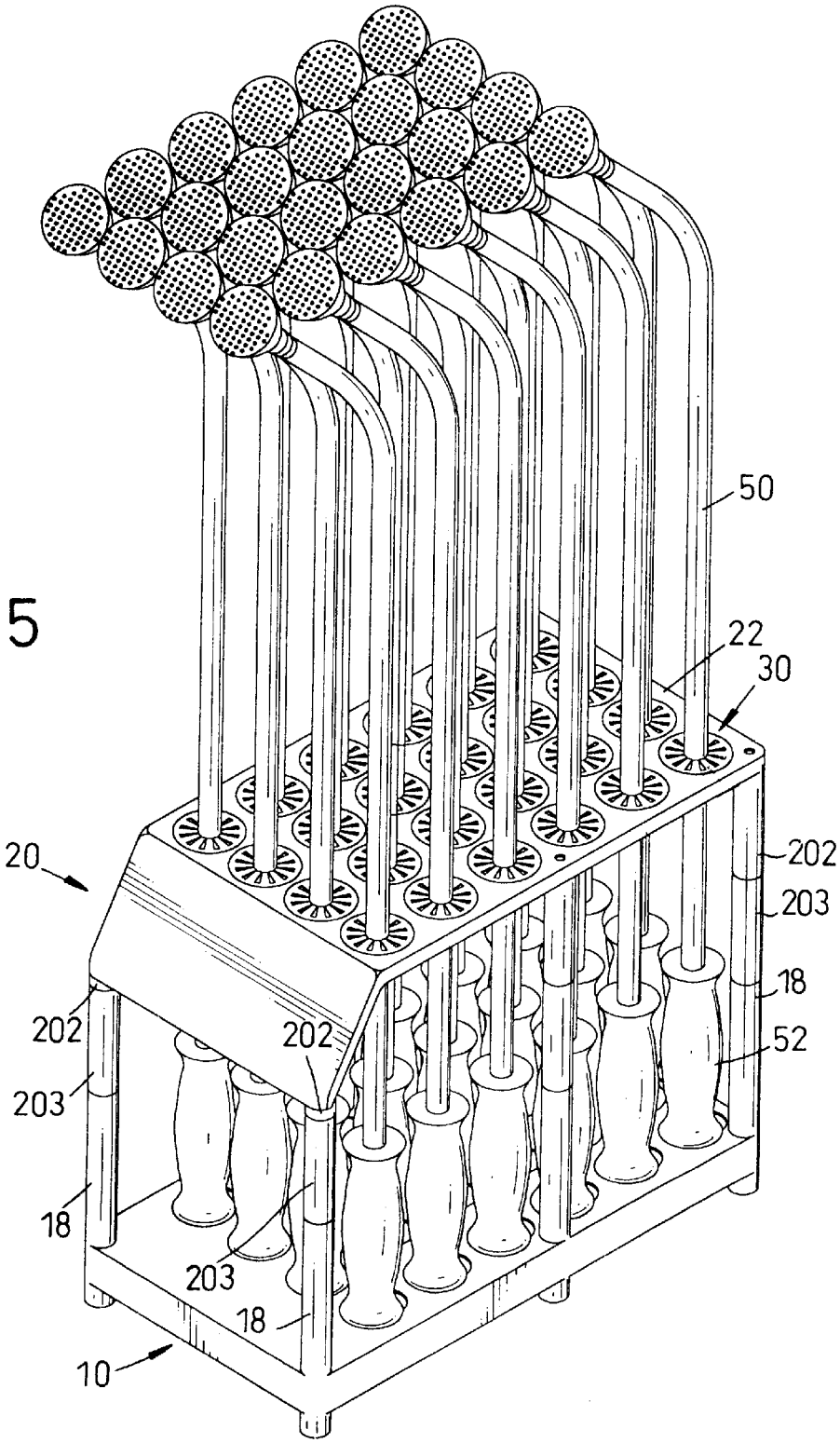
FIG. 5 is a perspective view of another embodiment of the display stand in accordance with the present invention with different extension rods.
Figure 6:
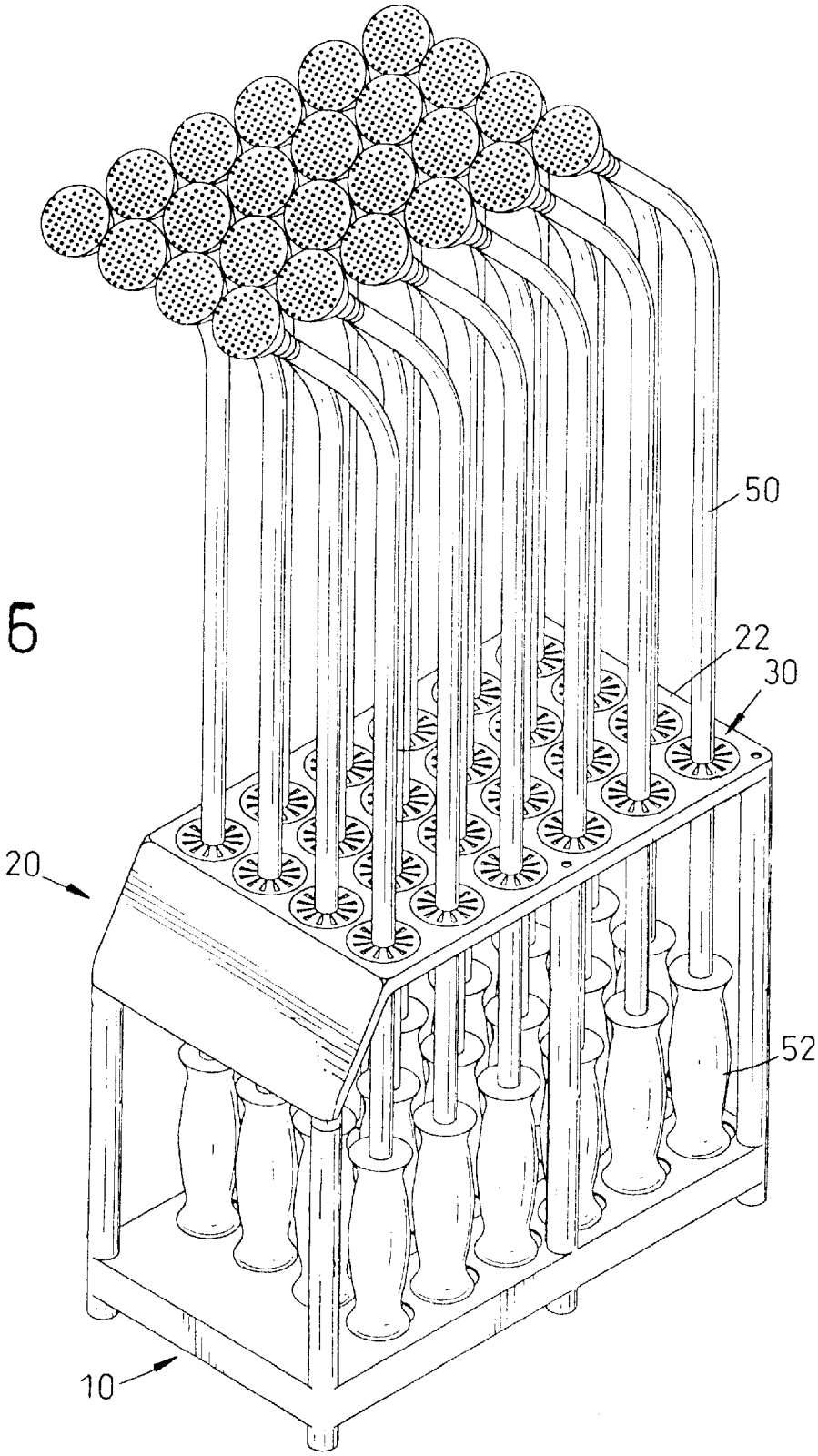
FIG. 6 is a perspective view of still another embodiment of the invention, wherein the legs and the hollow supports are formed into one piece.

With reference to FIG. 5 if longer sprinkler nozzles (50) are to be placed in the display stand, the user only needs to add a leg extension (203) to adjust the length of the legs (202) to adapt display stand to the longest sprinkler (50) in the display stand. Then sprinkler nozzles (50) of different sizes are able to be seated in the display stand. However, the legs (202) and the hollow supports (18) may integrally formed together as one piece as shown in FIG. 6.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A display stand for use with sprinkler nozzle comprising:

a bottom frame (10) having a bottom board (12) with blind holes (14) equally defined in the bottom board (12) to be adapted to accommodate handles of the sprinkler nozzles;

a top frame (20) having a top board (22) with multiple legs (202) extending down to engage with the bottom frame (10), through holes (24) each defined in the top board (22) to correspond to a corresponding one of the blind holes (14) in the bottom board (12) and retainers (30) each detachably mounted in a corresponding one of the through holes (24) and having resilient retaining plates (36) and a central through hole (38) adapted to allow the head of the sprinkler nozzle to pass through the retainer and to hold the head in position by the resilient retaining plates, wherein each of the through holes (24) of the top board (22) has a shoulder (26) formed on an inner face defining the through hole (24) and each of the retainers (30) has a first flange (32) and a second flange (34) separated from the first flange (32), such that after the retainer is inserted and held in the through hole (24), the first flange (32) is flush with an upper face of the top board (22) and the second flange (34) securely clamps a bottom edge defining the through hole (24).

2. The display stand as claimed in claim 1, wherein the bottom board (12) has multiple hollow supports (18) integrally formed on edges of the bottom board (12) to correspond to the legs (202) of the top frame (20) so that the bottom board (12) is able to engage with the top board (22).

3. The display stand as claimed in claim 2, wherein the supports and the legs are integrally formed with each other.

4. The display stand as claimed in claim 1, wherein each of the blind holes has a positioning plate securely mounted inside the blind hole for holding an adjusting knob on the sprinkler nozzle handle.

5. The display stand as claimed in claim 1, wherein each of the blind holes has a positioning plate securely mounted inside the blind hole for holding an adjusting knob on the sprinkler nozzle handle.

* * * * *